United States Patent [19]

Pope et al.

[11] 4,123,301

[45] Oct. 31, 1978

[54] METHOD FOR QUENCH HARDENING STEEL CASINGS

[75] Inventors: Thomas A. Pope, Munster; John M. Holleran, Dyer, both of Ind.

[73] Assignee: Republic Steel Corporation, Cleveland, Ohio

[21] Appl. No.: 757,774

[22] Filed: Jan. 7, 1977

[51] Int. Cl.[2] ..... C21D 9/08

[52] U.S. Cl. ..... 148/153; 148/156

[58] Field of Search ..... 148/153, 143, 156

[56] References Cited

U.S. PATENT DOCUMENTS 3,294,599 12/1966 Huseby ..... 148/143

*Primary Examiner*—R. Dean

*Attorney, Agent, or Firm*—Watts, Hoffmann, Fisher & Heinke Co.

[57] ABSTRACT

Steel casings are heated to above the transformation temperature and then quench hardened to achieve a fully martensitic structure. Thick-walled casings are quenched with an internal-external quench system, the casing passing within an external spray of quenching liquid and about a mandrel and a nozzle that apply a conical spray within the casing. After quenching, the mandrel and nozzle are rapidly and automatically withdrawn from the moving casing in the direction of casing travel. The casing is then moved out of its initial path and the nozzle is returned to within the external quench. Thin-walled casings are quenched with only an external spray directed both toward the casing and in the direction of casing travel when the casing enters the external quench and, prior to entry of the trailing end of the casing into the quench, the spray is directed both toward the casing and in a direction counter to that of casing travel, so quenching liquid is not directed into the ends of the casing.

9 Claims, 9 Drawing Figures

METHOD FOR QUENCH HARDENING STEEL CASINGS

BACKGROUND OF THE INVENTION

1. Field of the Invention

This invention relates to quench hardening of steel casings.

2. Prior Art

Steel oil well casings subjected to hydrogen sulfide environments must be fully martensitic in structure to resist corrosion and cracking.

Quench hardening, i.e., austenitizing by heating the steel casing to above the transformation range and then cooling rapidly enough to transform the austenite to martensite by water spray impingement has been used, particularly on the external surface, but also in combination with internal cooling. See, e.g., U.S. Pat. No. 3,140,964 to the hardening of a metal pipe with an external quench, and U.S. Pat. No. 3,294,599 to the treating of low carbon steel tubular members by continuous internal and external quenching.

Where only external quenching is used, quench cracks may result if the quench spray enters the open ends of the tubular member before it is cooled. One approach to solving this problem has been to apply an end plate that blocks entry of quench spray. Another has been to move the spray unit with the pipe or to stop the pipe as the trailing end approaches the spray head, until it is sufficiently cooled. All of these approaches have inherent inefficiencies.

Where internal and external quenching is required, as for casings that have relatively thick walls, support of the internal quench and removal of the casing or quenches after quenching is completed has been a problem that hampers efficient work flow and handling.

Such known approaches are not satisfactory where large quantities of casings must be processed efficiently and economically. Thus, a definite need has existed for an improved method and apparatus for accomplishing the quench hardening of steel casings in a manner that achieves a fully martensitic structure, and that permits a continuous product flow during the processing yet without the need for multiple, alternately used, structures.

SUMMARY OF THE INVENTION

The present invention provides improved methods and apparatus for quench hardening steel casing and the like, by which thick-walled casings can be internally and externally quenched effeciently and effectively to obtain full martensitic structure, and thinner-walled casings can be externally quenched in a manner that avoids quench cracking without capping the casing ends, and in both cases without interrupting the casing movement or transporting the quench apparatus during quenching. By the present process, high strength, hydrogen sulfide crack-resistant, casings suitable for lining oil well holes of so-called "sour wells" can be made. Such uses require a fully martensitic structure from the inside surface to the outside and a uniform hardness, to avoid failure from hydrogen sulfide attack. The quenching must therefore be carefully controlled to achieve this necessary hardness and uniformity. Typically, the quench hardened casing is subsequently tempered to reduce the brittleness.

Steel casings to be quenched are heated in a furnace to a temperature above the transformation temperature and are then conveyed from the furnace through an external quench and, if the wall thickness requires, about an internal quench located within the external quench.

External quenching is accomplished with an array of quench nozzles that surround a horizontal path along which a heated casing is conveyed. The array consists of horizontal pipes that extend a substantial distance longitudinally of the path and located equidistant therefrom in a circular arrangement. Alternate pipes together comprise a single set commonly supplied with fluid and have nozzles along the length directed toward the path and in the direction of casing movement. The other alternate pipes comprise a second set, commonly supplied, with nozzles directed toward the path and in a direction counter to the casing movement. By separately supplying fluid to the two sets, the direction of the externally applied quenching fluid can be controlled.

Internal quenching is accomplished with a nozzle on a mandrel through which fluid is supplied. The mandrel and supported nozzle of the internal quench project from a location remote from the external quench toward the source of heated pipes, generally along the path of casing travel and are received within a casing being quenched. The nozzle is constructed to produce a circumferential conical spray directed toward the casing wall and in the direction of casing movement. For purposes of facilitating continuous casing travel, the mandrel and nozzle are movable along the path of casing travel between a forward quenching location and a rearward location out of the casing.

To facilitate receipt of a casing over the mandrel and internal quench nozzle in the forward location, the mandrel is supported in a position aligned with the central longitudinal axis of the casing by a movable support located adjacent the exit end of the external quench. This support is automatically removed once the internal quench is received within the casing, to not interfere with movement of the casing along the mandrel. This external support locates the mandrel in a centered position and is removed after a time delay following the sensing of the hot casing between the furnace and the external quench. Once located within the casing, the mandrel is guided by skids that ride against the internal wall of the casing.

When both the external and internal quench are used, as with a casing having a thick wall, only the set of nozzles of the external quench that are directed in part in the direction of casing movement are supplied with quenching fluid, and fluid is also directed through the mandrel to the internal quench nozzle. The internal nozzle is located so a cone of quenching fluid impinges upon the internal wall of the casing in a plane common to the plane of initial impingement of flow of quenching fluid from the external quench.

In the preferred mode of external and internal quench operation, fluid is continually supplied to the external quench, but is only supplied to the internal quench when the mandrel and nozzle are in the forward position within the external quench. Casings are conveyed from the furnace to and through the external quench and about the internal quench on skewed rolls so that the pipes are rotated as well as moved longitudinally. As soon as the trailing end of a casing passes over the nozzle of the internal quench, the mandrel and nozzle are withdrawn from the casing at a speed substantially faster than the longitudinal casing movement. Once the mandrel and nozzle are removed, the casing is then directed and moved along a different path, preferably transversely to the path in which it moved through the quench, and the mandrel is returned to its forward position with the nozzle located within the external quench and supported in a central position by the external support.

Novel structure is provided for supporting the internal quench and for driving the mandrel and nozzle between its forward operating position and a rearward position that facilitates transverse movement of a casing after quench. This structure includes a rapid drive mechanism with sequence controlling cams; a vertically movable support for selectively locating the mandrel and internal quench nozzle in a position along the axis of casing movement; and a heat sensitive probe for controlling the movement of the external mandrel support and initiating the mandrel drive to assure efficient automatic operation that permits continual travel of casings through the heating furnace, quenching operation, and a subsequent tempering furnace.

For external quenching only, both sets of alternate rows of nozzles of the external quench apparatus are used, but in a timed sequence so that quenching fluid is supplied to one set at a time. Thus, when a leading end of a heating casing enters the external quench, flow is supplied only through that set of nozzles having a component in the direction of casing movement. When the trailing end of the casing approaches the external quench, the flow of quenching fluid is then supplied only through the other set of quenching nozzles to reverse the direction of flow to that having a component in a direction opposed to the direction of casing movement. As a result, quenching fluid is never directed toward an open end of the casing being quenched and is never impinged directly upon the internal surface of the casing, notwithstanding the ends being open and the external quench being stationary.

By virtue of this invention, relatively thick-walled casings are efficiently handled during quenching and are effectively quenched to obtain fully martensitic structure, and thin walled casings can be externally quenched quickly and conveniently without creating quench cracks by avoiding direct impingement upon the internal surface.

The above and other features of this invention will become better understood from the detailed description that follows, when considered in connection with the accompanying drawings.

DETAILED DESCRIPTION OF A PREFERRED EMBODIMENT

General Arrangement

Figure 1:
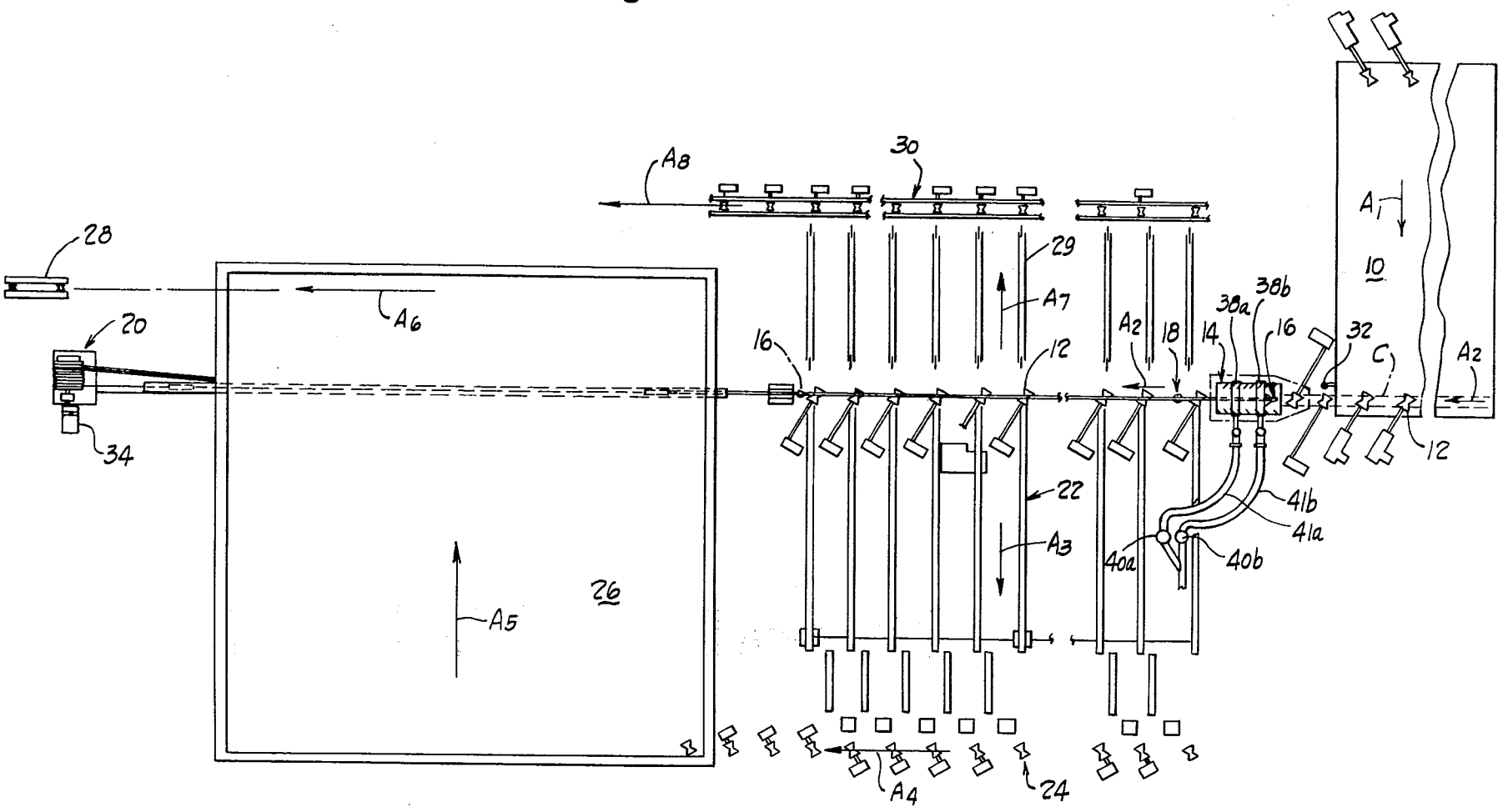
FIG. 1 is a plan view of apparatus for quench hardening steel casings and tempering the casings, in accordance with the present invention.

An overall arrangement for quench hardening and tempering steel casings is shown in FIG. 1 of the drawings, in which the path of movement of a casing C is indicated by various arrows A. The casing C is heated in a furnace 10 to a temperature above the transformation temperature of the steel alloy, to austenitize the steel. As the casing is heated in the furnace 10, it is moved in a direction transverse to its longitudinal extent from one side of the furnace to the other in the direction $A_1$ where it is then conveyed longitudinally in the direction $A_2$ by skewed rolls 12 from the furnace 10 through an external quench 14 and about an internal quench 16 within the external quench, where it is rapidly cooled to produce a fully martensitic structure.

The internal quench structure 16 is movable between a forward position shown in solid line in FIG. 1, and a rearward position shown in phantom. In the preferred embodiment, this is accomplished by a cable driven by a rotary drum assembly 20. The internal quench structure 16 in its forward position is initially supported above the skewed rolls 12, to enter the casing C, by a support 18 adjacent the external quench. The support is subsequently withdrawn after the casing is received about the internal quench structure. The drum assembly 20 is located a distance from the external quench 14, in the direction of longitudinal travel of the casing C, sufficient to permit complete withdrawal of the internal quench structure 16 from the casing after the casing has moved through the external quench structure.

A transfer table 22, downstream from the quenches 14, 16, transfers quenched casings from the travel path $A_2$ beyond the quenches, in a transverse direction $A_3$, to a skewed roll conveyor 24 where they are transported in a direction $A_4$ into a tempering furnace 26 and tempered to reduce brittleness. Casings in the tempering furnace 26 are moved sideways in the direction of the arrow $A_5$ during tempering, and are then transported from the tempering furnace in the direction $A_6$ to a conveyor 28. In the event it is desired to by-pass tempering, the casings can be conveyed from the rolls 12 in the direction $A_7$ across a cooling bed 29 to a conveyor 30 and then in the direction $A_8$.

In the operation of the apparatus, a casing is rotated and moved longitudinally through the quenches. When it has passed over the internal quench but is still within the external quench and moving in the direction $A_2$, the internal quench structure 16 is withdrawn by movement from the solid line position to the dotted line position of FIG. 1, and is thereafter returned to the solid line position after the quenched casing is moved transversely from its path, in the direction $A_3$. Operating sequences of the quench structure are controlled by a casing sensor 32 between the furnace 10 and the external quench 14, timers, and a rotary cam unit 34 driven with the drum assembly 20.

External Quench

Figure 4:
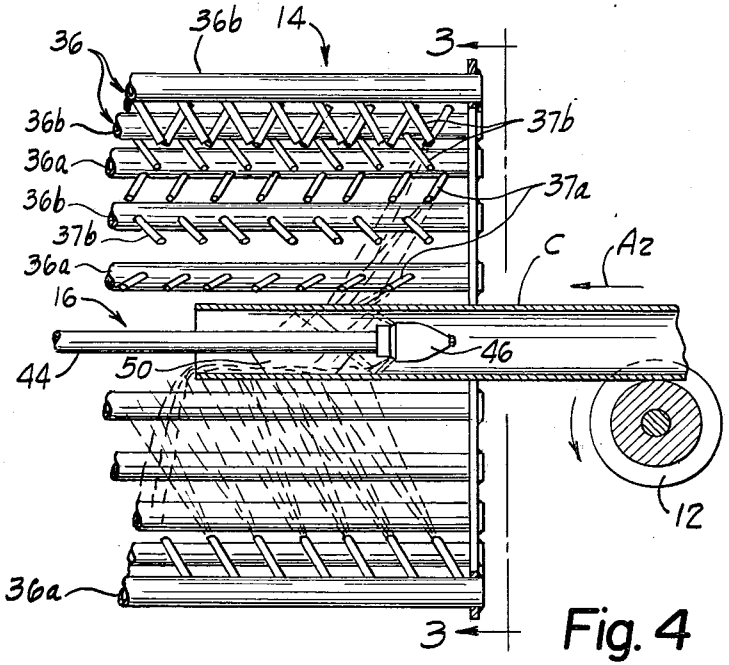
FIG. 4 is a longitudinal sectional view taken in a vertical plane, showing a portion of the external quench apparatus of FIG. 3 and the internal quench apparatus, and their relationship with a casing.
Figure 3:
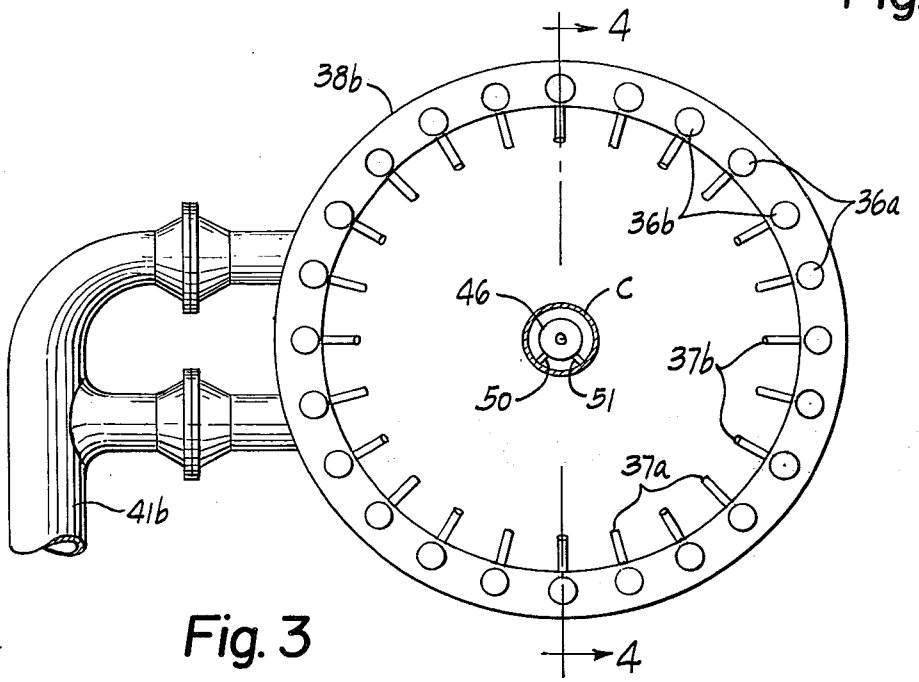
FIG. 3 is a partial end elevational view of an external quench apparatus constructed in accordance with the present invention.

Structure 14 for directing quenching medium to the external surface of a casing is shown in FIGS. 1, 3 and 4. The external quench structure is comprised of a plurality of horizontally extending pipes 36 that are parallel to the path of casing movement provided by the skewed rolls 12. The pipes 36 are in a circular arrangement, substantially equidistant from and surrounding the central path defined by the rolls 12.

The pipes 36 are arranged in two alternate sets. One set 36*a* has rows of nozzles 37*a* that are directed both toward the central path of casing movement and in the direction of longitudinal movement of the casing. The other set 36*b*, alternating with the pipes 36*a*, has rows of nozzles 37*b* that are directed both toward the central path of casing movement and in a direction counter to that of the longitudinal movement of the casing through the quench. Each set 36*a*, 36*b* is separately supplied by an annular manifold 38*a*, 38*b* (best shown in FIG. 1) that encircles the arrangement of pipes. A separate control valve 40*a*, 40*b* in a supply conduit 41*a*, 41*b* for each manifold selectively controls the flow of quenching fluid through respective manifolds and sets of pipes so that the direction in which the quenching medium is applied to a casing can be controlled.

When a casing is quenched externally only, quenching fluid is initially emitted through the set of pipes 36*a* as the casing enters and moves through the external quench 14. Prior to entry of the trailing end of the casing into the external quench unit 14, the flow of quenching fluid to the pipes 36*a* is stopped by operation of the control valve 40*a*, and at the same time fluid is applied through the sets of pipes 36*b* by opening the control valve 40*b* to the supply conduit 41*b*. As a result, the fluid is never directed into the interior of the casing during its movement through the external quench.

When a casing is quenched both internally and externally, quenching fluid is supplied only through the set of pipes 36*a* during the entire passage of the casing, and typically the fluid flow is continuous while a series of spaced pipes is moved through the external quench.

Internal Quench

Structure 16 for quenching the interior of a steel casing is shown in FIGS. 1, 3, 4 an 6. The structure comprises a mandrel 44 in the form of a pipe, longer than the casings to be quenched, and a nozzle 46 secured to the end of the mandrel. The mandrel 44 is supplied by a hose 48 from the rotary drum assembly 20.

Two skids 50, 51 are secured to the mandrel adjacent the nozzle and extend generally radially outwardly and downwardly, projecting a distance sufficient to support the nozzle centrally within a casing to be quenched, as the casing is moved over the nozzle and along the mandrel (See FIG. 3).

Figure 9:
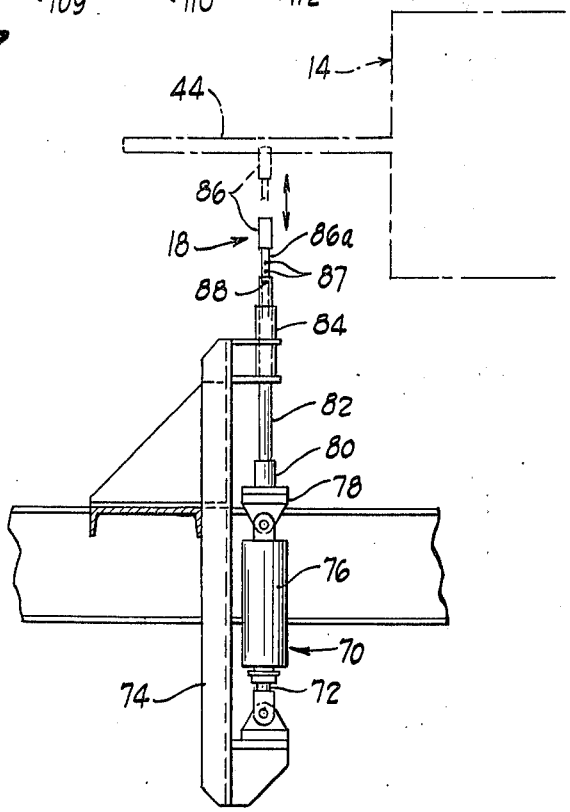
FIG. 9 is a side elevational view of a movable support for the mandrel and nozzle of the internal quench apparatus for locating the apparatus along the central axis of a casing to be quenched.

Prior to receiving a casing about the nozzle and mandrel, the mandrel is supported above the rolls 12, in a central location within the external quench where it will receive the casing, by the movable external support 18 shown in FIGS. 1 and 9.

The nozzle 46 is constructed to direct a continuous conical spray against the inside surface of a casing, from a location closely adjacent the internal surface. The spray has directional components both toward the casing surface and in the direction of casing movement. The forward location of the nozzle is established so that the spray impinges against the inside surface of the casing substantially in a plane common to that where the external spray initially contacts the outer casing wall.

Figure 6:
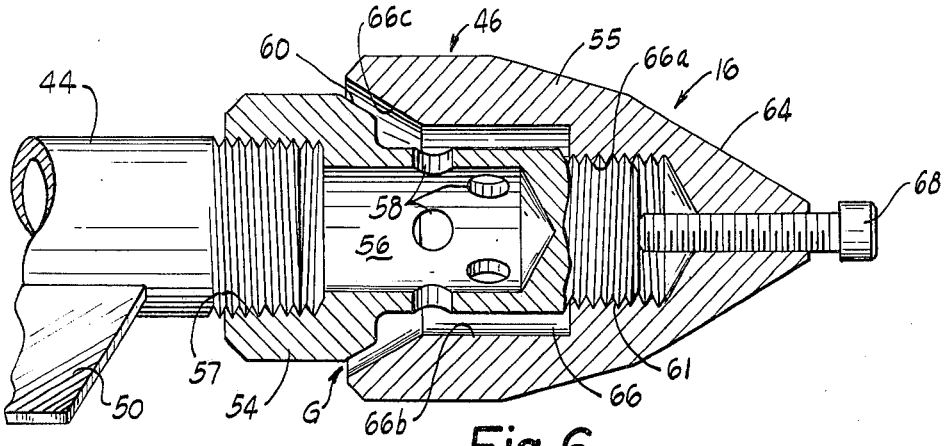
FIG. 6 is a view partly in section and partly in elevation showing details of an internal quench nozzle constructed in accordance with the present invention.
Figure 7:
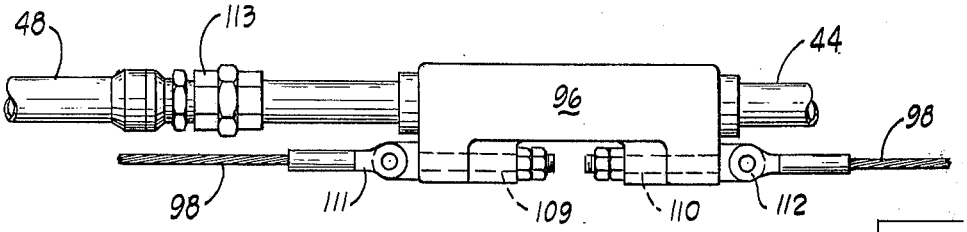
FIG. 7 is a side elevational view of a carrying block secured to the mandrel and hose of the internal quench nozzle, and illustrating the manner of connecting a cable drive to the block for reciprocating the block between forward and rearward positions.

As shown in FIG. 6, the nozzle includes a diffuser 54 and a deflector 55. The diffuser has a central chamber 56 that opens through a threaded passage 57 that is removably secured to the end of the mandrel 44. A plurality of circular openings 58 extend through the cylindrical wall of the diffuser for emitting fluid from the mandrel and chamber. The exterior of the diffuser 54 has a conical surface portion 60 behind the circular openings 58 (i.e., adjacent to the mandrel). The surface portion 60 tapers inwardly in a direction toward the front of the nozzle. The front end of the diffuser 54 has an externally threaded portion 61 for securing the deflector 55.

The deflector 55 has an outer tapered surface 64, to help guide it into the open end of a casing, and a central chamber 66. The central chamber has a threaded forward section 66*a* received on the threaded portion 61 of the diffuser, an intermediate cylindrical portion 66*b* that surrounds the diffuser portion having the circular openings 58, radially spaced to provide a passage for the flow of quenching fluid, and a conical terminating surface 66*c* adjacent the conical surface portion 60 of the diffuser, but of larger diameter at its open end, and tapering inwardly toward the front of the deflector. The two conical surfaces 60 and 66*c*, when spaced by virtue of the relative axial position of the deflector with the diffuser, create a continuous gap G through which quenching fluid escapes under pressure when supplied by the mandrel 44. Rotation of the deflector relative to the diffuser varies the width of the gap G between the two conical surfaces to control the spray of quenching fluid. Adjustment is retained between the deflector and diffuser by a bolt 68 carried by the deflector and abutting the end of the diffuser. Gaps of 0.075 to 0.120 inch have proved satisfactory.

Nozzles of different diameter are utilized with the mandrel for casings of different internal diameter. The nozzle is selected to fit closely within a casing so that the periphery of the nozzle is between ¼ inch and 1 inch from the inside surface. This assures that a fluid supplied to the nozzle under relatively high pressure will impinge against the inside surface of a casing under substantial pressure, uniformly about the interior wall, and will flow within the casing in the direction of casing movement, rather than forwardly in advance of the area upon which the spray impinges.

Mandrel Support

As shown in FIGS. 1 and 9, the mandrel support 18 is located adjacent the rear end of the external quench structure 14 and serves to selectively support the cantilevered end of the mandrel 44 above the skewed conveying rolls 12. In this manner, the internal quench structure 16 is located to receive a casing C as it enters the external quench. As shown in FIG. 9, the support 18 comprises a double acting pneumatic actuator 70 vertically oriented in alignment with, but beneath, the path of mandrel travel. A piston rod 72 of the actuator is connected to a fixed support 74, while the cylinder 76 carries an eye-bracket 78, with an attached socket 80 for mounting a push rod 82. The push rod 82 extends vertically through a fixed guide sleeve 84 secured to the same fixed structural support 74 as the actuator piston rod 72.

A pipe cradle 36 is secured to the end of the push rod 82. Preferably, for this purpose, the push rod is tubular and the pipe cradle has a stem portion 86*a* that fits within the end of the push rod. The stem has a plurality of cross holes 87 that cooperate with a cross pin 88 carried by the push rod. This permits the height of the cradle to be adjusted relative to the push rod to accommodate different diameter casings, so the location of the cradle, when the push rod is raised, will center the forward end of the supported mandrel and quench nozzle along the central axis of the casing. The actuator 70 has a sufficient stroke (approximately 7 inches in the preferred embodiment shown) to move the cradle 86 between a lowered position shown in solid line in FIG. 9, where it will not interfere with travel of the casing, and a raised position shown in dotted line, where it supports the nozzle 46 at the desired height.

Operation of the actuator 70 is under control of a suitable reversing valve operated to raise the support in response to the mandrel reaching a forward position with the nozzle in the external quench structure and to lower the support following a time delay after a casing is sensed during its advance to the quench. The time delay is sufficient to assure that the internal quench nozzle has been received within a casing, but not so long that the casing has reached the location of the external support.

Mandrel Drive

FIGS. 1, 2, 5, 7 and 8 show the general arrangement and the specific mechanisms for supporting and moving the mandrel 44 and the nozzle 46 of the internal quench between their forward and rearward positions.

Figure 2:
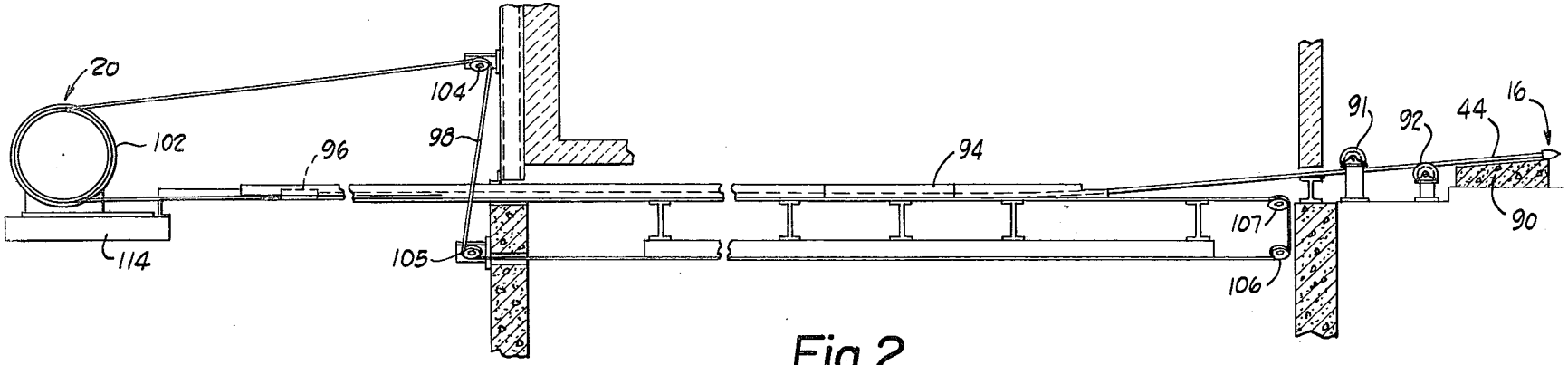
FIG. 2 is a side elevation view, with parts in section, illustrating the internal quench apparatus in a withdrawn or rearward position, and the drive assembly.

As FIGS. 1 and 2 show, substantial longitudinal travel is required for the mandrel and nozzle to clear a casing after the casing emerges from the external quench. In the present arrangement, for use in an existing plant, the location of the tempering furnace 26 necessitates a slight change in elevation of the path of the mandrel movement, to a slightly lower level in the rearward position than in the forward position. In the absence of such an obstruction, the mandrel would be moved along a path of constant level.

The nozzle 46, when in its rearward position shown in FIG. 2, is supported by a fixed guide 90, and the mandrel adjacent the nozzle is supported and deflected by two support rolls 91, 92, which establish a slight change in direction of the mandrel to accommodate the two levels along which it must pass during movement from the forward to rearward positions. A supporting trough 94 extends horizontally in the longitudinal direction of movement behind the rearward position of the nozzle 46. The trough extends substantially the length of the mandrel and supports and guides the mandrel as well as a drive block 96 attached to the mandrel, a driving cable 98 attached to the block, and the hose 48 attached to the mandrel. At its rear end, the trough 94 joins a horizontal hose guide 100 adjacent the rotary drum assembly 20 and terminates at the forward end behind the rearward position of the internal quench nozzle.

Figure 8:
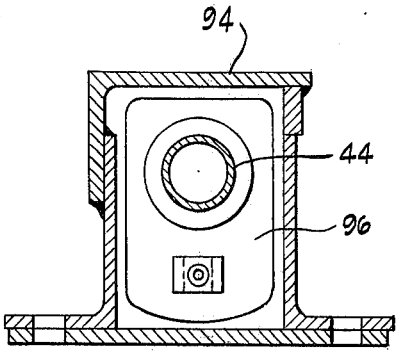
FIG. 8 is a transverse sectional view of a channel through which the block, mandrel and hose are guided in movement between forward and rearward positions.

As shown in FIG. 8, the trough 94 is covered and securely confines the drive block 96. The driving cable 98 is attached at both ends to opposite sides of the block 96, extends around a driven drum 102 of the rotary drum assembly 20, and is carried by pulleys 104–107 to a location at the front of the trough 94 beyond the forward position of the drive block 96 when the nozzle 46 is in its forward position.

The drive block 96 is horizontally split and clamped by bolts (not shown) to the mandrel. The block carries two eye-bolts 109, 110 extending from opposite ends. The eye-bolts are pinned to a clevis 111, 112 on each end of the driving cable 98. Movement of the cable, which is in the form of a loop, by rotation of the driven drum 102 about which a portion of the cable loop is wound, moves the block 96 in either direction.

The hose 48 is secured to the mandrel by a coupling 113 so that it not only supplies fluid to the mandrel, but also moves with the mandrel. Thus, when the drive block 96 is driven along the guiding trough 94, the mandrel 44 and the hose 48 are moved along with it, the hose being reeled in or paid out along with the cable 98 by the drum assembly 20.

Figure 5:
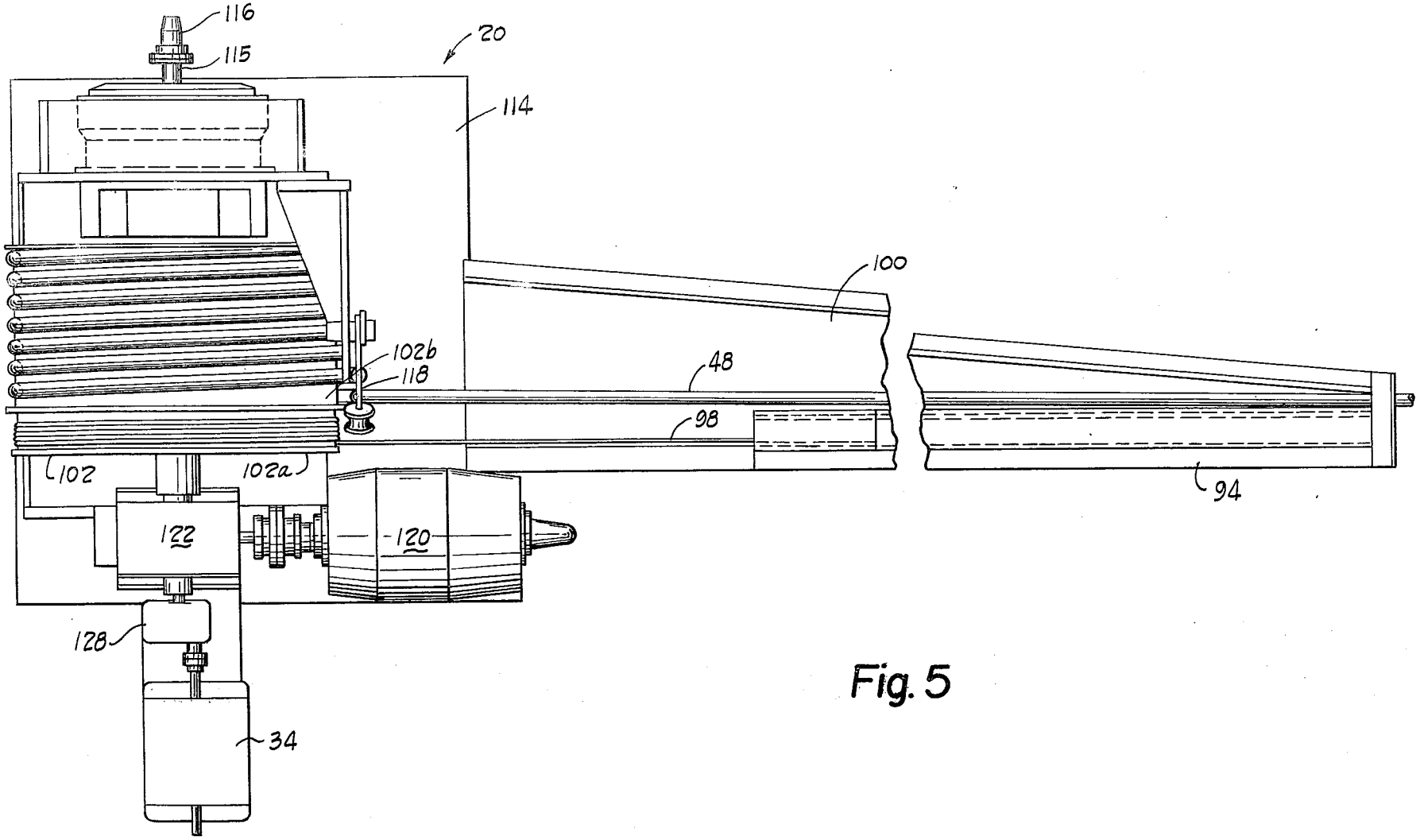
FIG. 5 is a top plan view of the drive mechanism for the internal quench apparatus.

The drum assembly 20 for driving the mandrel 44 is best shown in FIG. 5. The assembly includes the driven drum 102, which has dual reel portions 102*a*, 102*b*, and is supported on a fixed base 114. The drum 102 is oriented on the base so that its axis of rotation is perpendicular to the direction of travel of the mandrel 44, cable 98 and block 96. The drum supports the hose 48 on the reel portion 102*a* and the cable 98 on the reel portion 102*b*, side by side. The cable portion 102*b* of the drum is relatively narrow and is aligned with the supporting trough 94. The hose portion 102*a* of the drum is relatively wide, because of the substantial diameter of the hose 48. The hose guide 100 forms an apron alongside part of the trough 94 to support the hose as it leaves the trough, accommodating the wide path of transverse movement of the hose across the width of the drum. The diameter of the reel portion 102*a* for the hose is less than the diameter of the cable portion 102*b* so the center line of the hose 48 will lie along the same diameter as the center line of the cable 98 when both are wound about the drum. Both will then be wound at the same linear rate for each revolution of the drum to assure that undue stress will not be applied to either the cable or the hose, while both will be retained taut during operation. The inlet end of the hose 48 is connected to a supply conduit on the drum, which receives fluid from a source through a central pipe 115 with a rotary fitting 116, and the hose is guided along the drum during winding, by a weighted biasing arm 118. The drum is driven by an electric motor 120 through a gear box 122.

The multicam limit switch unit 34 is driven from the drum drive through a gear reducer 128 to provide control functions timed with the cable movement and, hence, the block position. The cams and limit switches control the quench water flow, and stop the drum rotation at a desired forward and rearward position of the mandrel. Rotation of the drum is directly controlled by a brake (not shown) releasable by a timer when rotation is to begin.

Operation

Operation of the apparatus and the steps of the process of quench hardening steel casings are best understood by way of example, in this case, the production of high-strength, hydrogen sulfide-cracking resistant, seamless, steel casing.

Suitable casing steel is produced in open hearth or electrical furnaces, fully deoxidized, using fine grain practice. The casings are pierced by the seamless process. Each casing is then quench hardened and tempered, producing a fully martensitic structure. Typically, the wall thicknesses for different casings may vary between 0.25 and 1.5 inch, and those with a thickness greater than 0.5 inch require internal and external quenching.

Composition of the steel used for casings in this example (determined by ladle chemical analysis) in percent by weight, was: carbon 0.30–0.31, manganese 0.40–0.60, phosphorous 0.02 max., sulfur 0.03 max., silicon 0.20–0.35, copper, 0.30 max., nickel 0.10 max., chromium 0.95–1.15, and molybdenum 0.20–0.25.

Casings produced as above, having a 7 inch outside diameter and a wall thickness of 0.730 inch, were austenitized by heating them to a temperature of 1575° F. They were then internally and externally quenched using the external and internal quenching units previously described. In the external quench unit, each set of nozzles 37*a*, 37*b* is supplied by a set 36*a*, 36*b* of 12 pipes approximately 12 feet long, with 30 nozzles to each pipe. The internal quench structure was as shown in FIG. 6, with a gap or opening G between the diffuser and deflector of 0.075 inch and with the nozzle located to impinge the spray produced through the gap against the inside of the casing in substantially the same transverse plane as that at which the leading spray from the external quenching nozzles cantacted the outside of the casing.

Water was used as a quenching fluid in the internal and external quench apparatus, at a temperature of 83° F., and was applied through the external quench nozzles at 105 pounds per square inch and through the internal quench nozzle at 70 pounds per square inch. Casings were conveyed from the furnace 10 and through the quenches at a speed of 23 feet per minute. The casings were subsequently tempered in the furnace 26 by being heated to a temperature of 1200° F.

The microstructure of the quenched casings consisted of essentially 100% martensite. After tempering, the quenched casings showed a uniform tempered martensitic structure. Through-wall hardness ring samples were taken and exhibited an as quenched Rockwell hardness ($R_c$) of 38.7 to 45.3 and a Rockwell hardness ($R_c$) after tempering of 20 to 27, yield strength of 111,000–113,000 pounds per square inch, and a tensile strength of 120,000–126,500 pounds per square inch.

Each casing, after being heated to an austenitizing temperature in the furnace 10 and as it was conveyed from the furnace, was sensed by the sensor 32 before entering the quenches. The sensor 32 initiated operation of a timer that, after a suitable delay to allow the casing to enter the external quench unit and receive the internal quench nozzle 46, caused the external mandrel support 18 to be lowered to a level beneath the travel path of the casing.

Quench water was discharged continuously through the external quench throughout the processing of casings, but through the internal quench nozzle only while the nozzle 46 was at the forward, quenching, position. Since, in this example, both the internal and the external quenches were used, only the set of nozzles 37*a* of the external quenching apparatus was used.

After the leading end of the casing to be quenched entered the quenching structure, the trailing end left the furnace and was sensed by the sensor 32, which started a second timer. After allowing time for the trailing end of the casing to pass over the internal quench nozzle 46, but while the trailing end is still within the external quench, the second timer caused a brake to be released on the drive for the rotary drum assembly 20 and the drum 102 was rotated in a direction to move the block 96 by the cable 98 to the rearward position at a speed substantially faster than that at which the casing was moving. The mandrel was moved approximately 75 feet during the time the casing moved approximately 15 feet. When the drum began rotation, a cam in the cam assembly 126 operated a control switch to stop the flow of water to the nozzle 46. When the drum rotated sufficiently to move the block 96 a distance of approximately 75 feet, a cam in the assembly 126 operated a switch to stop the drum drive.

After the casing moved a sufficient distance for its trailing end to clear the external quench structure, the leading end struck a probe (not shown) along its path of movement, causing the casing to be kicked out of its travel path by conventional conveying equipment and to roll in a direction transversely of its travel through the quench, to the skewed roll conveyor 24, along which it is then conveyed to the tempering furnance 26.

The drum 102 was then rotated in the opposite direction by a manual restart (alternatively it could have been rotated automatically in response to the casing striking the probe), moving the nozzle 46 back into its quenching position within the external quench structure. When the nozzle reached its forward position, cams in the cam assembly 126 operated switches to stop the drum rotation, raise the external mandrel support 18, and start the flow of quenching water through the drum, hose and mandrel to the nozzle 46. At this time, the quenching apparatus was ready to receive the next casing, then leaving the furnace 10.

Where only the external quench is used, as with casings having relatively thin wall thicknesses, the mandrel 44 and nozzle 46 remain in the rearward position shown in FIG. 2. The external quench is operated in an alternate manner, first through the one set of nozzles 37*a* and then switched to operate through the second set of nozzles 37*b*, each time in response first to the sensing of the leading end of the casing moving between the furnace 10 and the external quenching structure 14 and then the trailing end. That is, with the quenching water being emitted through the set of nozzles 37*a* having a component in the direction of casing movement, the casing enters the quench. While the casing is moved through the quench, the trailing end is sensed as it exits the furnace 10, at which time the supply of quenching water is shifted from the nozzles 37*a* to the nozzles 37*b* having a component of direction counter to the direction of casing movement. After the trailing end of the casing has traveled into the external quench structure 14 a sufficient distance, the quenching water can be reversed, in response to the sensing of the leading end of a subsequent casing exiting the furnace.

While a preferred embodiment of the present invention has been described in detail, it will be apparent that various modifications or alterations may be made therein without departing from the spirit or scope of the invention set forth in the appended claims.

What is claimed is:

1. In the quenching of a steel casing while it is moved longitudinally, a method comprising:

heating the casing in a furnace to a temperature suitable for quenching, moving the casing from the furnace in a path extending in the longitudinal direction of the casing through an external quench and about an internal quench established through structure at the end of a fluid supply tube longer than the casing, supporting the supply tube adjacent the external quench to locate the internal quench structure in a position to be received within the casing, sensing the casing after at least a portion leaves the furnace and in response thereto removing the support after the internal quench structure is received within the casing and before the casing reaches the support, quenching the casing by directing quenching fluid against internal and external surfaces of the casing as the casing is moved through the external quench and about the internal quench, initiating removal of the internal quench structure from the moving casing after the casing passes beyond said structure and while still at least partially within the external quench by moving said structure in the same longitudinal direction as the casing but at a substantially faster speed until after it leaves the casing, then moving the casing transversely out of longitudinal alignment with the internal quench structure, returning said structure to a position within the external quench, and again supporting said structure adjacent the external quench in a location to be received within a casing.

2. A method as set forth in claim 1 including the step of supplying fluid to the internal quench structure only while it is within the external quench.

3. A method as set forth in claim 2 wherein said internal quench structure is supplied with quenching fluid through a flexible hose, and including the steps of moving the internal quench structure longitudinally by a driven loop and reeling the hose to and from a drum at the same liner rate as the loop is driven.

4. A method as set forth in claim 3 wherein a slidable carrier for the hose and internal quench structure is moved by said driven loop along a longitudinal guide.

5. In a method of quench tempering steel casing for use in lining oil wells, said casing having wall thicknesses between 0.5 and 1.5 inch, the steps comprising:

heating the casing to an austenitizing temperature, while the casing is at an austenitizing temperature, moving it longitudinally and rotationally through an external water quench and around an internal water quench, directing the flow of water of each quench in a direction having a component both toward the casing wall and in the direction of longitudinal casing movement, impinging the flow of water against internal and external surfaces of the casing to quench the casing, controlling the rate of travel of the casing in the longitudinal direction, and controlling the temperature and pressure of the quench water, to attain essentially a 100% martensitic structure, upon completion of the quenching, moving the internal quench structure in the same longitudinal direction that the casing is moving but at a substantially faster speed until the internal quench structure is removed from the casing, delivering water during quenching to said internal quench through a flexible hose attached to said internal quench structure, winding and unwinding said hose as the quench structure is moved, changing the direction of movement of the quench casing to a direction transverse to the longitudinal direction, thereafter returning the internal quench structure to a location within the external water quench, and tempering said quenched casing.

6. The method as set forth in claim 5 wherein said internal quench is established by emitting a continuous spray throughout 360° from a distance between ¼ and 1 inch from the inside surface of the casing being quenched at a pressure on the order of 70 pounds per square inch or move and an annular nozzle opening for the flow of water on the order of 0.075 to 0.120 inch.

7. A method of externally quenching a steel casing in which the casing is heated, conveyed through an external quench in which water is sprayed against the external surface of the casing in a direction having components toward the casing and in the direction of longitudinal casing movement to quench the casing, the improvement comprising changing the direction in which water is sprayed against the external surface of the casing before the trailing end of the casing reaches the external quench to a direction having a component both toward the casing and in a direction opposite to the longitudinal casing movement to avoid directing water from the external quench into the ends of the casing during quenching.

8. In a method of controlling a quench cycle for steel casing conveyed through an external quench and about an internal mandrel and nozzle, wherein the nozzle has a quenching position at a first location within the external quench and a withdrawn position remote from the external quench, the steps comprising:

supplying quenching fluid to the external quench and impinging the fluid upon the outside of the casing to quench the casing, supplying quenching fluid to the internal quench only when it is located within the external quench and impinging the fluid upon the inside of the casing to quench the casing, sensing the approach of a heated casing being conveyed along a path to the external and internal quenches, supporting the mandrel adjacent to and behind the external quench, considered in the direction of casing movement, removing the mandrel support at a predetermined time following the sensing of the approach of the casing to the quenches, said time being sufficient to allow the pipe to enter the external quench and receive the internal quench but insufficient to allow the leading end of the pipe to exit from the external quench, sensing the trailing end of the casing before it enters the external quench, at a predetermined time following the sensing of the trailing end of the casing, withdrawing the mandrel and nozzle from the external quench and from the casing while, and at a speed substantially faster than, the casing is being conveyed, said time being sufficient to allow the trailing end of the casing to pass over the internal quench nozzle and into the external quench, conveying the casing transversely of its path of movement through the external quench after the mandrel and nozzle have been withdrawn from the moving casing, returning the nozzle to said first location, and re-supporting the mandrel adjacent to and behind the external quench.

9. The method as set forth in claim 8 wherein the mandrel and nozzle are withdrawn by a rotating drive member, and simultaneously rotating control members in synchronism therewith to control the flow of fluid through the nozzle and the extent of movement of the mandrel and nozzle.

* * * * *